United States Patent [19]

Schmetz

[11] Patent Number: 4,709,904

[45] Date of Patent: Dec. 1, 1987

[54] VACUUM FURNACE FOR HEAT-TREATING A CHARGE

[75] Inventor: Peter Schmetz, Menden, Fed. Rep. of Germany

[73] Assignee: Schmetz GmbH & Co. KG, Menden, Fed. Rep. of Germany

[21] Appl. No.: 868,300

[22] Filed: May 28, 1986

Related U.S. Application Data

[62] Division of Ser. No. 731,058, May 5, 1985, Pat. No. 4,612,064.

[30] Foreign Application Priority Data

May 8, 1984 [DE] Fed. Rep. of Germany ..... 3416902

[51] Int. Cl.[4] ..... C21D 1/74

[52] U.S. Cl. ..... 266/250; 266/252; 266/259

[58] Field of Search ..... 266/250, 252, 259, 249

[56] References Cited

U.S. PATENT DOCUMENTS

| | | | |
|---|---|---|---|
| 3,301,541 | 1/1967 | Ipsen | 266/250 |
| 4,009,872 | 3/1977 | McCoy | 266/250 |
| 4,030,712 | 6/1977 | Rogers | 266/252 |

*Primary Examiner*—Christopher W. Brody
*Attorney, Agent, or Firm*—Becker & Becker, Inc.

[57] ABSTRACT

A method and vacuum furnace for heat-treating a charge. Pursuant to the method, after the charge is placed in the receiving vessel, the latter is evacuated and flooded with inert gas. Subsequently, the charge is heated to the maximum permissible operating temperature of the circulation device by heating and gas circulation. Thereafter, the charge is heated to the desired end temperature by static inert gas or under vacuum, and essentially by radiation heat. The vacuum furnace may include a steel vessel which can be closed off, and which contains an inner heating chamber for receiving the charge. A heating device is provided within the heating chamber, and a fan and a gas guiding arrangement are provided for producing a gas circulation through the heating chamber. In the second phase, in which the heating is effected by radiant heat, the heating chamber can be closed off, accompanied by disconnection of the fan. For this purpose, an opening is provided in the wall of the heating chamber. This opening can be closed off by a sliding plug.

3 Claims, 3 Drawing Figures

20
5
22
6
18
23
19
25
24
21
26
17
3
4
16
8
11
7
15
14
1
12
9
13
10
2

VACUUM FURNACE FOR HEAT-TREATING A CHARGE

This is a divisional application of co-pending parent application Ser. No. 731,058-Schmetz filed May 5, 1985, now U.S. Pat. 4,612,064-Schmetz dated Sept. 16, 1986.

BACKGROUND OF THE INVENTION

1. Field of the Invention

The present invention relates to a method of heat-treating a charge of metallic workpieces, or of a single workpiece, in a vessel which can be closed off and evacuated. Furthermore, the present invention relates to a vacuum furnace for carrying out such a method. This furnace includes a steel vessel which can be closed off, and which contains an inner heating chamber for receiving the charge. Heating means are provided within the heating chamber, and a gas fan and a gas guiding arrangement are provided for producing a gas circulation through the heating chamber.

2. Description of the Prior Art

Vacuum furnaces of this general type are known. When a charge is heated in the vacuum, the energy transfer is effected nearly exclusively by radiation. In such a situation, the energy which can be transmitted is a function of the temperature. In practice, this means that heating to about 750° C. is effected very slowly. Furthermore, shadow effects occur which make the desired uniform heating of the charge difficult to achieve.

An object of the present invention is to provide a method, for heat-treating a charge, which makes possible a more rapid heating, and with which at the same time there is achieved a uniform distribution of heat within the charge.

A further object of the present inventionis to provide a vacuum furnace which is suitable for carrying out the inventive method.

BRIEF DESCRIPTION OF THE DRAWINGS

These objects, and other objects and advantages of the present invention, will appear more clearly from the following specification in conjunction with the drawings, which schematically illustrate a vacuum shaft furnace, and in which.

SUMMARY OF THE INVENTION

Figures 1A, 1B:
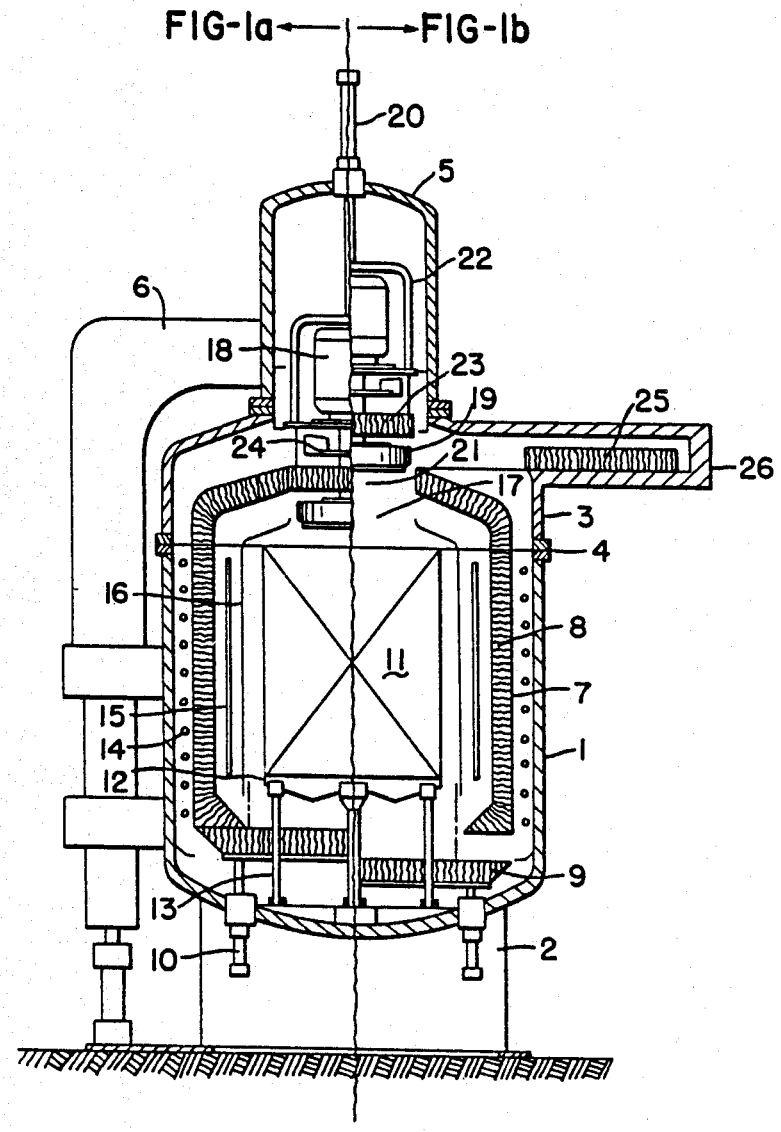
FIG. 1*a* is a half vertical sectional view of this exemplary inventive vacuum furnace in the operating position "heating with gas circulation"
FIG. 1*b* is a half vertical sectional view of the vacuum furnace in the operating position "cooling with gas circulation"

The method of the present invention is characterized primarily in that the vessel, after the charge is placed therein, is evacuated and flooded with inert gas or buffer gas, the charge is subsequently heated up to the maximum permissible operating temperature of the circulating device by means of heating and gas circulation, and thereafter the charge is heated to the desired end temperature of the heat treatment, with static inert gas or under vacuum, essentially by radiant heat.

Pursuant to the inventive method, in a first stage, the charge is heated by circulating heating gas, i.e. essentially by convection heat, up to a temperature which is permissible for the circulation device, and in a subsequent second stage, the charge is heated to the desired end temperature, either with static inert gas or under vacuum, essentially by radiant heat.

Prior to the start of the second stage, the circulation device is protected in a suitable manner from the effect of the higher temperatures. Such a method makes possible an overall more rapid and more uniform heating of a charge than was possible with the heeretofore known methods.

The vacuum furnace of the present invention is characterized primarily in that, to heat the charge in the second stage, the heating chamber can be closed off accompanied by disconnection of the fan.

Pursuant to one advantageous specific embodiment of the present invention, the wall of the heating chamber may contain an opening, which can be closed off by a sliding plug having integrated therein a thermal insulation layer. The gas fan may be movable back and forth between a rest position and a working position in such a way that the fan is disposed outside of the heating chamber in the rest position, whereas in the operating position, when the sliding plug is opened, the fan projects into the interior of the heating chamber. Furthermore, the back of the fan may be provided with a stopper or plug having integrated therewith a thermal insulation layer, with this stopper serving to close off the opening when the fan assumes the operating position.

A vacuum furnace of this type is flooded in the first treatment stage with inert gas or a buffer gas. With the aid of the fan, which projects into the heating chamber, and with the aid of the gas conveying or guiding arrangement, this inert gas is circulated in the heating chamber in such a way that the energy from the heating elements is transmitted not only by radiation but also by convection onto the charge which is to be heated. As soon as the maximum operating temperature of the fan is achieved, the latter is withdrawn from the heating chamber, and the opening is closed off by a sliding plug. Subsequently, in the second stage, the charge can be heated to the desired end temperature either with a static inert gas atmosphere or, after renewed evacuation, under a vacuum.

DESCRIPTION OF PREFERRED EMBODIMENTS

Referring now to the drawings in detail, a vacuum shaft furnace having vertical charging was selected for describing one specific embodiment of the present invention. This furnace comprises a cylindrical lower part 1, which rests upon the floor via a support structure 2, and an upper part 3, which is detachably connected with the lower part 1 in the junction plane 4. A hood 5 is mounted on the top of the upper part 3 by means of a flange connection. A raising and pivoting apparatus 6 is provided for raising the upper part 3 from the lower part 1, and for swinging it laterally out. The apparatus 6 rests upon the floor via a base, and is connected to the side wall of the lower part 1.

The lower part 1 and the upper part 3 are composed of sheet steel, and form a vacuum tight, sealed vessel in the operating mode. Disposed within this vessel is a similarly cylindrical heating chamber 7, the walls of which are provided with a thermal insulation layer 8. The bottom 9 of the heating chamber 7 can be lowered, and for this purpose rests upon the ends of the piston rods of lifting cylinders 10, which are mounted in the bottom of the lower part 1 of the furnace. With the aid of these lifting cylinders 10, the bottom 9 of the heating chamber 7 can be moved out of the closed position into an open position, and vice versa; these two positions are illustrated in FIGS. 1*a* and 1*b*.

To support the charge 11, which in the drawing is indicated by a rectangle, within the heating chamber 7 there is provided a support footing 12, which is supported on the bottom of the lower part 1 by means of a support structure 13, which essentially comprises vertical columns. The bottom 9 of the heating chamber 7, as previously mentioned, can be raised and lowered; for this purpose, the bottom 9 is provided with openings in which the vertical columns of the support structure 13 are slidingly guided.

Cooling tubes 14, for example in the form of a spiral of finned tubes, are disposed in the intermediate space between the lower part 1 and the heating chamber 7. Heating elements 15, for example electrical resistance heating elements, are disposed within the heating chamber 7 near the inner surface thereof. Also provided within the heating chamber 7 is a gas conveying arrangement 16, which is disposed in the intermediate space between the heating elements 15 and the charge 11. This gas conveying arrangement 16 is guided toward the middle at the top in the manner of a hood, leaving free a central opening 17.

Disposed within the upper hood 5 is a fan motor 18, with a fan wheel 19 being supported at the end of the downwardly extending motor shaft. The fan motor is mounted to the free end of the piston rod of a lifting cylinder 20; with the aid of this lifting cylinder 20, the fan motor 18 can be lowered from an upper rest position into a lower operating position, and vice versa. As was the case with the gass conveying or guiding arrangement 16, an opening 21 of approximately the same size is contained in the top of the heating chamber 7; the fan wheel 19 can enter the interior of the heating chamber 7 through this opening 21. A circular stopper or plug 23, which has an appropriate thermal insulation layer, is mounted on the piston rod of the lifting cylinder 20 by means of the support linkage 22; in the operating position of the fan motor 18, the stopper 23 closes off the opening 21 of the heating chamber 7. Furthermore, a cooling disk 24 for the shaft of the fan motor 18 is provided on the back of the stopper 23; the cooling disk 24 is also mounted on the support linkage 22.

Figure 2:
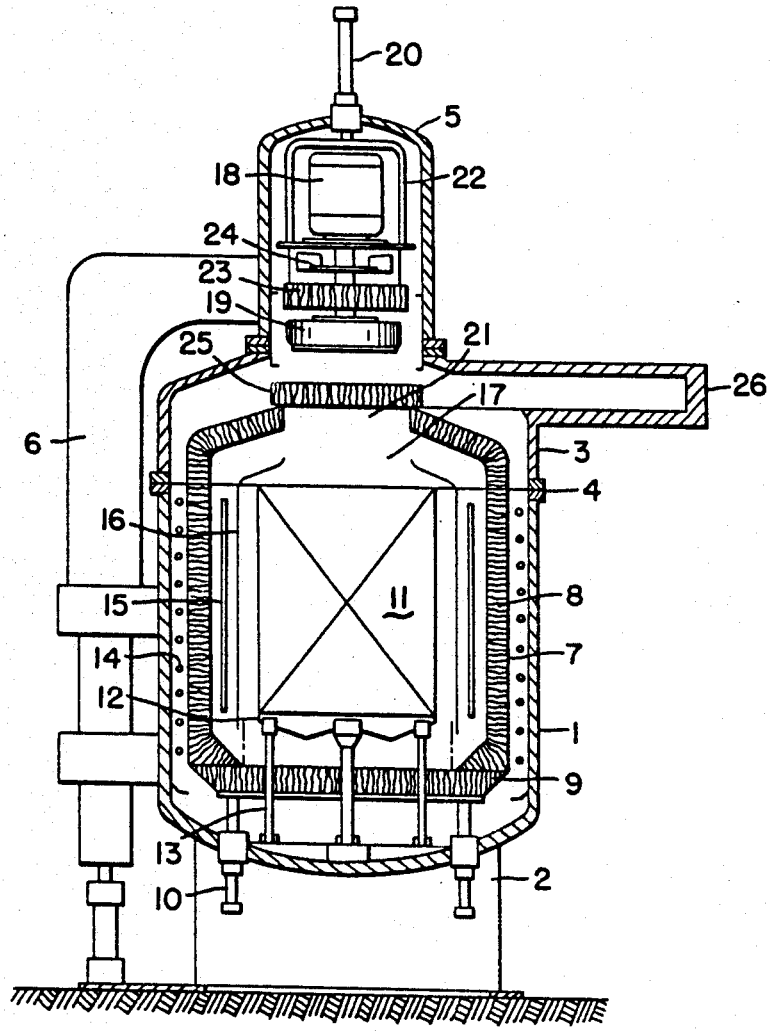
FIG. 2 is a vertical sectional view of the vacuum furnace in the operating position "heating while disconnecting the gas fan".

To close off the heating chamber 7 in that phase of operation in which the fan motor 18 assumes a rest position, there is provided a sliding plug 25, which, like the wall of the heating chamber 7, is provided with a thermal insulation layer. As shown in FIG. 2, this sliding plug 25 can be moved back and forth between an inserted operating position and a lateral rest position. For this purpose, a laterally projecting connecting piece 26 is formed on the upper part 3.

In order to heat-treat a charge, the above-described vacuum shaft furnace in employed as follows:

FIG. 1*a* shows the operating state for heating with gas circulation up to a temperature of approximately 750° C. The fan motor 18 assumes the lower operating position, in which the fan wheel 19 is disposed at the level of the opening 17 of the gas conveying arrangement 16. The inert gas or buffer gas located within the heating chamber 7 is circulated out of the interior of the gas conveying arrangement 16 upwardly into the intermediate space between the arrangement 16 and the wall of the heating chamber 7. In so doing, the gas flow is heated by the heating elements 15, and at the lower end of the intermediate space again enters the interior of the gas conveying arrangement 16. When the maximum permissible temperature for the fan 19 has been achieved, the fan motor 18 is moved back into the rest position illustrated in FIG. 2. The opening 21 of the heating chambere 7 is closed off by the sliding plug 25. In this phase, the charge 11, either with static inert gas or under vacuum, is essentially heated by radiant heat up to the desired end temperature, for example 1150° C.

The subsequent cooling is again effected with gas circulation. For this purpose, the sliding plug 25 is withdrawn from the opening 21, and the fan motor 18 is lowered into the intermediate position illustrated in FIG. 1*b*. Furthermore, the bottom 9 of the heating chamber 7 is lowered, as is also illustrated in FIG. 1*b*. In conjunction with the gas conveying or guiding arrangement 16, and with the aid of the fan 19, the gas is now again circulated upwardly out of the heating chamber 7, into the intermediate space between the heating chamber 7 and the lower part 1, downwardly past the cooling tubes 14, and then back into the interior of the heating chamber 7.

The present invention is, of course, in no way restricted to the specific disclosure of the specification and drawings, but also encompasses any modifications within the scope of the appended claims.

What I claim is:

1. A vacuum furnace for heat-treating a charge as rapidly as possible to about 750° C. heat-treating temperature permissible for a circulation device in a first stage and in a second stage the charge is heated by radiation heating to a higher desired end temperature with an overall more rapid and more uniform heating of the charge although the circulation device is protected from effect of higher temperatures in the second stage, comprising:

a steel vessel which can be closed off;

means forming a heating chamber, provided in said vessel, for receiving said charge;

heating elements provided within said heating chamber;

fan assembly means including a fan as the circulation device capable of being disposed in said vessel;

means for movement of the entire fan assembly means projected into an operating position within said vessel only during said first stage and retracted into a rest position externally of said vessel during said second stage so as to remove and protect the fan as the circulation device from effect of higher temperatures in the second stage;

a gas guiding arrangement for gas conveying guided in the manner of a hood disposed in said heating chamber and located axially inside said vessel, with said fan and said gas guiding arrangement during the first stage cooperating to produce a gas circulation internally through said heating chamber; and means to close off said heating chamber and separate said heating chamber from said fan in rest position during the second stage at the higher temperatures.

2. A vacuum furnace according to claim 1, in which said means forming the heating chamber has a wall which contains an opening; in which said means for closing off said heating chamber includes a sliding plug, which is provided with a thermal insulation layer and can selectively close off said opening; and in which said means further includes a lifting cylinder device, connected to said vessel, for moving said fan back and forth between the rest position during the second stage and the operating position during the first stage, with said fan assembly means including the fan being disposed entirely outside of said heating chamber in said rest position during the second stage, and being disposed within said heating chamber during the first stage, with said opening being open to permit movement of the entire fan assembly means during change of positioning of said fan in a range between said operating position in the first stage and relative to said rest position in the second stage.

3. A vacuum furnace according to claim 2, in which said fan is provided with a stopper, which is provided with a thermal insulation layer, and which serves to close off said opening of said heating chamber when said fan is in its operating position within said heating chamber.

* * * * *